United States Patent [19]

Paton

[11] Patent Number: 4,531,648

[45] Date of Patent: Jul. 30, 1985

[54] RAILWAY CAR DRAFT GEAR WITH SLACK ADJUSTMENT AND CUSHIONING

[76] Inventor: H. Neil Paton, 1218 Third Ave., Suite 1022, Seattle, Wash. 98101

[21] Appl. No.: 430,494

[22] Filed: Sep. 30, 1982

[51] Int. Cl.[3] ..... B61G 7/10

[52] U.S. Cl. ..... 213/50; 213/64; 213/59

[58] Field of Search ..... 213/22, 51, 53, 55, 213/56, 59, 60, 61, 62 R, 64, 69, 71, 75 R, 188, 50

[56] References Cited

U.S. PATENT DOCUMENTS

| | | | |
|---|---|---|---|
| 583,548 | 6/1897 | Price | 213/188 |
| 918,583 | 4/1909 | O'Connor | 213/69 |
| 1,232,594 | 7/1917 | Newell | 213/56 |
| 1,399,563 | 12/1921 | Kelso | 213/69 |
| 1,399,609 | 12/1921 | George, Jr. | 213/69 |
| 1,443,716 | 1/1923 | Pletcher | 213/69 X |
| 2,149,840 | 3/1939 | Christianson | 213/61 X |
| 2,209,229 | 7/1940 | Kjolseth | 213/64 X |
| 2,240,363 | 4/1941 | Barrows et al. | 213/71 |
| 2,241,353 | 5/1941 | Kinne et al. | 213/71 X |
| 2,282,146 | 5/1942 | Mealing | 213/71 X |
| 2,318,472 | 5/1943 | Dwyer, Jr. et al. | 213/59 X |
| 2,327,240 | 8/1943 | Barrows et al. | 213/71 |
| 2,380,018 | 7/1945 | Blomberg et al. | 213/61 |
| 2,922,531 | 1/1960 | Hammond | 213/62 R |
| 2,933,200 | 4/1960 | Quinn et al. | 213/22 |
| 3,399,787 | 9/1968 | Zanow | 213/64 |
| 3,494,481 | 2/1970 | Smith | 213/69 |
| 3,716,146 | 2/1973 | Altherr | 213/64 X |
| 4,243,149 | 1/1981 | DePenti | 213/69 X |
| 4,252,068 | 2/1981 | Nolan | 213/51 X |
| 4,258,628 | 3/1981 | Altherr | 213/75 R X |
| 4,336,758 | 6/1982 | Radwill | 213/75 R X |

FOREIGN PATENT DOCUMENTS

| | | | |
|---|---|---|---|
| 1230955 | 4/1960 | France | 213/64 |

*Primary Examiner*—Robert B. Reeves
*Assistant Examiner*—Glenn B. Foster
*Attorney, Agent, or Firm*—Finnegan, Henderson, Farabow, Garrett & Dunner

[57] ABSTRACT

The draft gear includes a slack adjustment and cushioning assembly mountable within a female connector for pin connection with a male connector inserted therein. The assembly is made up of a follower which contacts the rear end of the male connector, a slack adjustment wedge, a buff taper plate cooperable with the wedge to take up slack during draft loads, and an elastomeric pad which acts between the buff taper plate and a backing surface to maintain slack adjustment during draft loads and to provide resilient cushioning support during a pitching force or buff load. The assembly is applicable to drawbar couplers and to articulated connectors.

4 Claims, 4 Drawing Figures

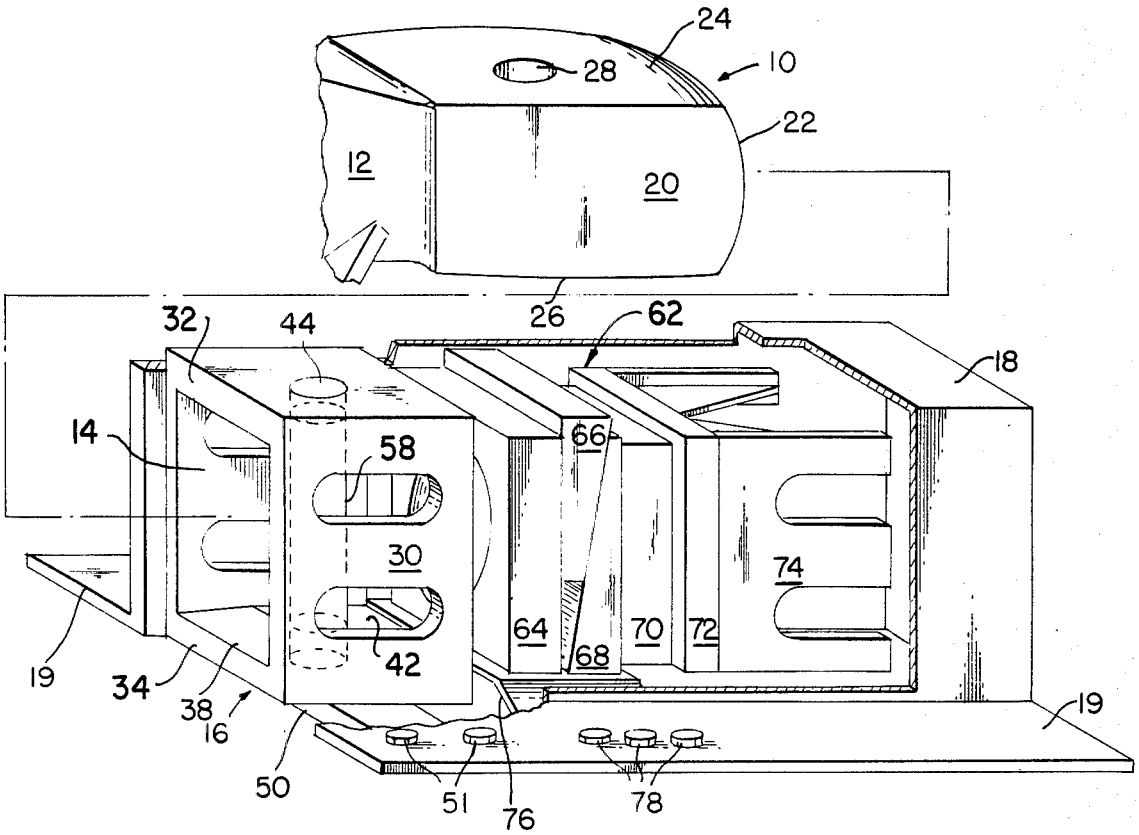
FIG. 1
FIG. 2
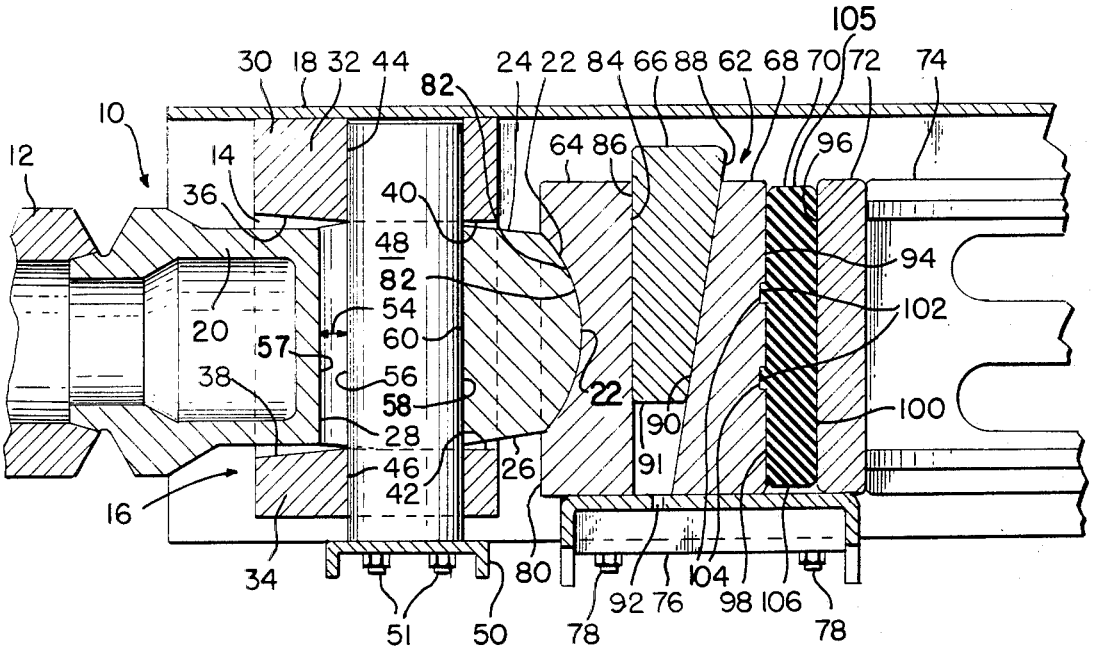

RAILWAY CAR DRAFT GEAR WITH SLACK ADJUSTMENT AND CUSHIONING

BACKGROUND OF THE INVENTION

This invention relates to railway car draft gear and, more particularly, to railway car draft gear providing slack adjustment and cushioning. While this invention is suitable for use in a drawbar coupler or in an articulated connector and is illustrated and described herein in both applications, it may be used in other types of draft gear or couplers.

A typical railway car draft gear of this type is disclosed in U.S. Pat. No. 4,258,628. The draft gear is made up of a male connecting member adapted to be received within a cavity formed by a female connecting member, the two being joinable by a pin insertable through bores in each that become aligned when the male member is inserted into the cavity. To absorb slack and absorb shock between this pin and the bore of the male connecting member, the end of the male member is convex and is engagable in face-to-face contact with a concave surface formed in the forward face of an elastomerically supported follower. The rear face of the follower includes two slots in which two elastomeric strips are mounted, respectively, in vertical parallel alignment between opposed retaining shoulders. These strips normally protrude from their slots a distance sufficient to maintain a longitudinal space between the rear face of the follower and the vertical front face of a gravity actuated wedge, the inclined rear surface of which bears against the correspondingly inclined face of the female member at the rear of the cavity. Metal strips are bonded to the exposed faces of the elastomeric strips and bear against the front face of the wedge to establish a frictional retaining force for maintaining the wedge in a vertical disposition related to the degree of wear in the mating male, female and follower surfaces and, hence, the required slack adjustment. Due to the space maintained between the follower and wedge, horizontal and vertical pitching motions between the male and female members, such as may occur when the railway car negotiates a curve, are absorbed by total or partial compression of one or both of the elastomeric strips. Additionally, the elastomeric strips absorb and cushion longitudinal compression between the male and female members during application of buff loads. Other draft gear of this type, but without elastomeric cushioning such as that just mentioned, are disclosed in U.S. Pat. Nos. 3,716,146 and 4,336,758.

One drawback of this type of draft gear is that adjacent load bearing surfaces may come into metal-to-metal contact under certain conditions involving shifting between the male and female members, such as may occur in an articulated connector, for example, when subjected to pitching motion during curves, whether vertical or horizontal. This produces an effect similar to "spring bottoming" in coil springs, in which the spring force obtained becomes nonlinear and the spring effectively loses its resilience when it is compressed to the point that its coils come into mutual contact. This is possible with the elastomeric strips mentioned above in the event the magnitude of the pitching or buff load causes one or both strips to be compressed to the extent that the longitudinal space between the follower block and wedge becomes nonexistent. In this instance, spring bottoming effects could lead to misalignment of the wedge and a comcommitant degradation in slack adjustment since the wedge may shift in relation to the frictional retaining force exerted by the metal strips under the forces applied by the elastomeric strips during compression. The magnitude of this force, of course, is related to the total surface area of these strips, and may be insufficent to overcome the spring bottoming effects produced by severe pitching forces or buff loads. Similarly, the magnitude of this force and hence wedge misalignment could result from permanent compressive set in the elastomeric strips after being compressed substantially for a prolonged time period. This also could lead to the occurance of excess slack during application of a draft load. Such spring bottoming and compressive set effects, either singularly or in combination, could result in undesirable train run-in or run-out. Still another drawback of the particular draft gear mentioned above is that the female connector is formed from a casting which must be fitted to the draft sill. Consequently, conventional draft sills must be modified to fit properly, or else the casting must be tailored to fit with a specific draft sill, or both.

SUMMARY OF THE INVENTION

This invention provides railway car draft gear having automatic slack adjustment and cushioning through the use of an elastomeric cushioning arrangement that simplifies the support required for the elastomeric element and eliminates the need for maintaining a space between the follower and wedge. According to this invention, the wedge is located between the follower and a buff taper plate having a front contact surface which is inclined oppositely to and interfaces with the inclined surface of the wedge. A single elastomeric pad is compressed between the vertical rear surface of the buff taper plate and a backing surface provided by a vertical front surface formed by a support plate or the face of the female member at the rear end of the cavity, depending upon whether the invention is used with a drawbar system or an articulated connector, as the case may be. The elastomeric pad has a surface area which is essentially coextensive with the areas of the rear surface of the buff taper plate and the backing surface, and is in continuous face-to-face contact with both. Thus, there is no longitudinal space between these surfaces, as in the case of the follower and wedge surfaces of the draft gear previously mentioned. Additionally, as applied to couplers, and in some cases as applied to articulated connectors, the female connector may be mounted as a unit by bolts, welding or other appropriate means within a conventional draft sill, or the female connector of a conventional articulated connector.

With the construction, it is possible, by fabricating the pad of sufficient thickness, to ensure that the rear surface of the buff taper plate and the backing surface do not come into metal-to-metal contact, regardless of horizontal or vertical shifting of the male and female members or the magnitude of pitching or buff loads that may applied under even the most severe conditions. The pad also provides sufficient resilience to respond to all anticipated draft forces by continuously urging the follower block into engagement with the end of the male member. Further, the position of the wedge is maintained in a positive manner through face-to-face interdiction between the follower and the buff taper plate under the bias exerted by the pad. Hence, these elements tend to move conjointly in fixed relative positions when subjected to pitching or buff loads so that the wedge member does not tend to shift except as required to take up slack caused by interface wear. As applied to drawbar couplers, this construction also eliminates the need for forming the female connector as a casting and, therefore, yields versatility and economies in application to conventional draft sills.

These and other features, objects and advantages of the present invention will become apparent with the detailed description and claims to follow, taken in conjunction with the accompanying drawing in which like parts bear like reference numerals.

BRIEF DESCRIPTION OF THE DRAWINGS

FIG. 1 is a perspective view of a first presently preferred embodiment of the railway car draft gear of this invention as applied to a drawbar, with a portion of the draft sill broken away;

FIG. 2 is a longitudinal section of the FIG. 1 drawbar;

DETAILED DESCRIPTION OF THE DRAWINGS

Figure 3:
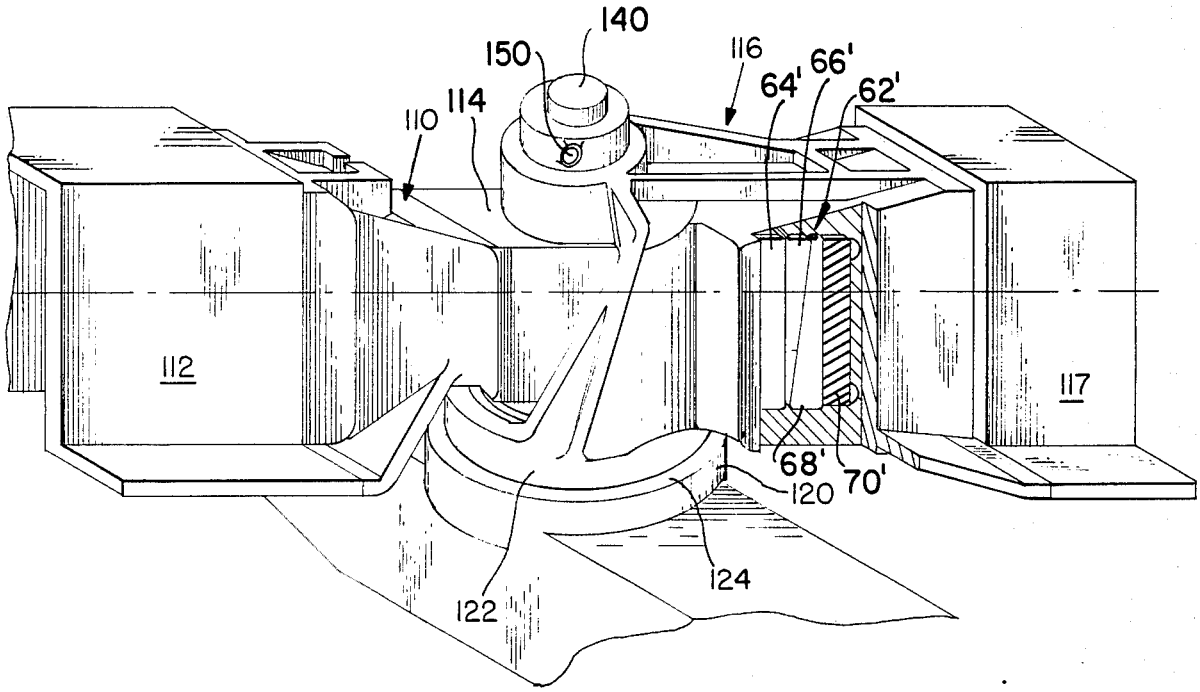
FIG. 3 is a perspective view of a second presently preferred embodiment of the railway car draft gear of this invention as applied to an articulated connector, with a portion of the female connector broken away.
Figure 4:
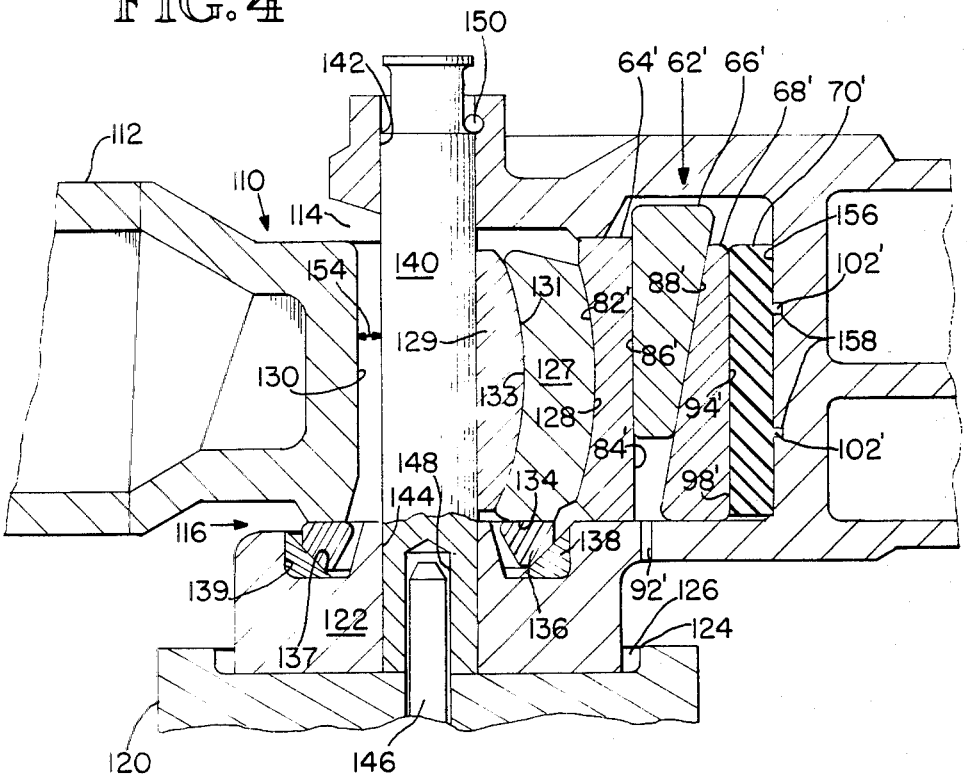
FIG. 4 is a longitudinal section of the FIG. 3 connector.

Two presently preferred embodiments of this invention are suitable for use, respectively, in a drawbar coupler, as depicted in FIGS. 1 and 2, and in an articulated connector, as depicted in FIGS. 3 and 4. Referring first to the drawbar application of this invention of FIGS. 1 and 2, a male connector (generally referenced by numeral 10) supported by a drawbar tube 12 is insertable within a cavity 14 formed by a female connector (generally referenced by numeral 16) which, in the example illustrated, is mounted by a conventional hat-shaped draft sill 18 having coplanar lower flanges 19.

As most clearly shown in FIG. 2, the male connector includes a drawbar 20 having a convex rear surface 22, convex upper and lower surfaces 24 and 26, and a vertical cylindrical bore 28. The female connector includes a box member 30 having upper and lower walls 32 and 34 which form cavity 14 and provide convergent forward surfaces 36 and 38, and parallel rear surfaces 40 and 42, respectively. Member 30 is welded, bolted or otherwise secured to sill 18 in load transmitting relation. Walls 32 and 34 further include vertically aligned cylindrical bores 44 and 46. A draft pin 48 is supportable by a support plate 50, which extends transversely across the open lower end of sill 18 and is secured at its ends to flanges 19 by bolts 51 (FIG. 1). Plate 50 supports the draft pin 48 in a position in which it extends vertically through bores 28, 44 and 46 when coaxially aligned following insertion of drawbar 20 into box member 30, as shown (FIG. 2). This pin is inserted from the top of the draft gear through an access hole (not shown) formed in sill 18, and hence through bores 28, 44 and 46 when coaxially aligned. Bore 28 is larger in diameter than bores 44 or 46, forming a clearance space 54 between the front face 56 of the draft pin and the front face 57 of bore 28 when the drawbar 20 is subjected to draft loads. On the other side, the rear face 58 of the draft pin is engaged with the rear face 60 of bore 28 under draft load conditions.

Clearance space 54 is selected to permit rearward longitudinal shifting of connector 10 with respect to draft pin 48 in response to application of buff loads. Such shifting, however, is opposed by the combination slack adjustment and cushioning assembly generally referenced 62 to be described presently. The clearance space 54 also permits the drawbar 20 to rock or pitch vertically within cavity 14. Surfaces 24 and 26 roll against surfaces 40 and 42, respectively, to guide the drawbar during such movement. Drawbar 20 also is rotatable about the longitudinal axis of draft pin 48. Draft loads are transmitted from drawbar 20 to sill 18 via draft pin 48 and member 30. Buff loads, on the other hand, are transmitted via surface 22 to assembly 62.

The slack adjustment and cushioning assembly 62 includes several serially arranged elements which, proceeding from front to rear, are a follower 64, a wedge 66, a buff taper plate 68, an elastomeric pad 70, a buff stop face plate 72 and a buff stop 74. An inverted U-shaped support plate 76 extends transversely across the open lower end of sill 18 and is secured at its ends to flanges 19 by bolts 78 (FIG. 1) to draft sill 18. This plate underlies and supports the follower 64, wedge 66, buff taper plate 68 and the buff stop face plate 72. The buff stop 74 is secured separately to the draft sill in load transmitting relation by welding, bolts or other appropriate means. The buff stop face plate 72 and buff stop 74 could be combined in a single part.

The front surface 80 of the follower 64 includes a recess 82 which conforms in contour to that of the rear surface 22 of the drawbar. The mating contours of these surfaces are such that they will remain in face-to-face contact during horizontal and vertical shifting of the drawbar. The rear surface 84 of the follower is vertical and is in face-to-face contact with the vertical front surface 86 of wedge 66. The rear surface 88 of wedge 66 is inclined and is in face-to-face contact with the correspondingly inclined front face 90 of the buff taper plate 68.

Wedge 66 is of a height less than the heights of follower 64 and buff taper plate 68 so that sufficient clearance exists between its lower end 91 and support plate 76 to permit the wedge to move progressively downward between follower 64 and buff taper plate 68. This of course causes follower 64 and buff taper plate 68 to be spread apart along the longitudinal axis of the female connector so as to take up any slack that may exist between the mating contact surfaces 22, 82, and 58, 60. The vertical position of wedge 66 and hence the amount of slack adjustment obtained may be controlled by inserting an appropriatly elongated member not shown through a lift hole 92 formed in plate 76, and then pushing the end of this member against lower end 91 so as to move wedge 66 upwardly to a position in which the transverse spreading force exerted by wedge on the follower 64 and buff taper plate 68 produces an acceptable slack adjustment.

The elastomeric pad 70 is interposed between the rear surface 94 of buff taper plate 68 and the front surface 96 of buff stop face plate 72. Pad 70 includes parallel front and rear contact surfaces 98 and 100 which are in respective face-to-face contact with surfaces 94 and 96. One or more projections 102 extend transversely from surface 98 and are receivable by registration recesses 104 in surface 94, as shown (FIG. 2). These projections serve to position pad 70 and to maintain it in longitudinal alignment with buff taper plate 68 and buff stop face plate 72 when compressive forces are relaxed during application of draft loads for example. As most clearly illustrated in FIGS. 1 and 3, surfaces 98 and 100 essentially are coextensive in area with surfaces 94 and 96, less upper and lower gaps 105 and 106 adjacent the upper and lower edges of pad 70. These gaps are of a size sufficient to allow the upper and lower edges of pad 70 to bulge when pad 70 is compressed between surfaces 94 and 96. As will now be appreciated, pad 70 provides resilient, cushioning support between the buff taper plate 68 and buff stop face plate 72, and prevents them from entering into metal-to-metal contact under buff loads, even during severe pitching force and buff loads. As a consequence, pitching forces or buff loads are opposed by a cushioning force that is unimpaired by the effects of spring bottoming as described above. Further, the slack adjustment position of wedge 66 tends to be unaffected by applied loads, since the frictional force exerted on the wedge is not subject to such effects and is independent of frictional contact with the pad itself.

A particular advantage of FIGS. 1 and 2 drawbar coupler is that it may be mounted or installed in a conventional draft sill, as in sill 18, without modification or retrofit. Assembly 62 is so constructed that it may be housed within conventional draft sills, with support provided by plate 76, as shown (FIGS. 1 and 2). Plate 76 is simply secured to the draft sill to support assembly 62, while member 30 and buff stop 74 are, in the example, merely welded to the interior of the draft sill. Likewise, plate 50 is simply secured to the draft sill. Consequently, the FIGS. 1 and 2 draft gear may be installed for use in a drawbar coupler with minimal or no modification or retrofit to the draft sill.

Referring now to the articulated connector application of this invention of FIGS. 3 and 4, parts corresponding to those already illustrated and described with reference to FIGS. 1 and 2 are designated with the same reference numerals, primed. An articulated connector such as that employed to interconnect two units of an articulated railcar is made up of a male connector (generally referenced by numeral 110) which is insertable within a cavity 114 formed by a female connector (generally referenced by numeral 116). In the example, connector 110 is welded at its forward end to a draft sill 112, and connector 116 is welded at its rear end to a draft sill 117. Sills 112 and 117 are associated, respectively, with adjacent units (not shown) of an articulated railcar. Connector 116 is supported rotatively by a center bowl 120 mounted on the bolster of an underlying four wheel truck (not shown). Connector 116 includes a base portion 122 having a cylindrical outline, which registers with and is guided by an upstanding rim 124 which encircles a circular recess 126 of bowl 120.

As most clearly shown in FIG. 4, the male connector includes an end portion 127 having a convex rear surface 128 which contacts the front surface 82' of follower 64' in face-to-face relation. The male connector further includes a bearing block 129 which rides within a generally cylindrical bore 130 and which includes a convex rear surface 131. This surface contacts a concave rear surface 133 of bore 130 in face-to-face relation. An annular lower support surface 134 surrounds the lower end of bore 130 and rests upon a support ring 136, as shown (FIG. 4). This ring 136 includes an inclined lower surface 137 which rests upon a correspondingly inclined upper surface of an annular bearing 138. This bearing is located in a circular recess 139 formed by portion 122 in coaxial alignment with recess 126. A primary draft pin 140 is supported in vertical coaxial alignment within an upper cylindrical bore 142 and a lower cylindrical bore 144, both formed by connector 116, as shown (FIG. 4). A centering pin 146 projects upwardly from bowl 120 into a bore 148 formed in the lower end portion of pin 140 for maintaining it in coaxial alignment with recess 126. Pin 140 is inserted downwardly from the top of connector 116 through bore 142 and thence through bore 130 and bore 144 until bore 148 engages pin 146. Pin 140 is retained in this position by a retaining pin 150 which keys to bore 142. As in the case of bore 58 (FIG. 2), bore 130 is of a diameter larger than bores 142 and 144, forming a clearance space 154 corresponding to space 54.

Like the FIGS. 1 and 2 drawbar coupler, space 154 permits connector 110 to rock or pitch vertically within cavity 114; however, unlike that coupler, surface 134 remains in contact with ring 136, which tilts with respect to bearing 138 during such vertical shifting of connector 110. Bearing bearing block 129 simultaneously shifts within the end portion 127 while their respective contact surfaces 131 and 133 remain in face-to-face contact so as to guide connector 110 during such movement. Connector 110 also is rotatable horizontally about the longitudinal axis of pin 140. Draft loads are transmitted from connector 110 via pin 140 to connector 116. Like the FIGS. 1 and 2 drawbar coupler, buff loads are transmitted via surface 128 to the slack adjustment and cushioning assembly 62'.

The slack adjustment and cushioning assembly 62' as illustrated in FIGS. 3 and 4 is identical to the FIGS. 1 and 2 assembly 62, except that the rear wall 156 acts as the backing surface in place of the buff stop face plate 72 (FIG. 1). Additionally, the position of the elastomeric pad 70' is reversed so that projections 102' are engaged in recesses 158 formed in wall 156. In all other respects, assembly 62' and those parts designated by corresponding but primed reference numerals operate in the same manner and afford the same advantages as the FIGS. 1 and 2 assembly 62.

Like the FIGS. 1 and 2 drawbar coupler, the FIGS. 3 and 4 articulated connector may be installed or mounted to a conventional draft sill, or may be retrofitted to the female connector of a conventional articulated connector. In some instances, the male and female connectors 110 and 116 simply may be welded or otherwise secured to respective ends of conventional draft sills, as shown (FIG. 3). Alternatively, assembly 62' may be mounted or installed within the male connector receiving cavity of the female connector of a conventional articulated connector, provided the cavity affords sufficient space and clearance. Rear stops (not shown) could be mounted to the female connector to provide a backstop for pad 70' in place of wall 156.

While two presently preferred embodiments have been illustrated and described herein, variations will become apparent to one of ordinary skill in the art. Accordingly, the invention is not to be limited to the specific embodiments illustrated and described herein, and the true scope and spirit of the invention are to be determined by reference to the appended claims.

The embodiments of the invention in which an exclusive property or privilege is claimed are defined as follows:

1. A draft gear, comprising:

(a) a female connector having a cavity;

(b) backstop means operatively associated with said cavity;

(c) a male connector having an end insertable into said cavity, said end including a bore;

(d) draft pin means connectable to said female connector and extendable through said bore for securing said male connector in said cavity with the end of said male connector spaced from said backstop means, said draft pin means being sufficiently smaller than said bore that the end of said male connector is movable with respect to said draft pin means between a first position in which said bore contacts one face of said draft pin means during application of draft loads and a second position in which said bore contacts another face of said draft pin means opposite said one face during application of buff loads; and (e) combination slack adjustment and cushioning means acting between said backstop means and the end of said male connector for normally maintaining said male connector in said first position, but allowing it to shift against a resilient resistance toward said second position in response to a buff load and a pitching force, said slack adjustment and cushioning means comprising;

(i) a follower adapted to engage the end of said male connector, (ii) a buff taper plate, (iii) wedge means acting between said follower and said buff taper plate for controlling the spacing between them in order to take up slack, and (iv) resilient cushioning means acting between said buff taper plate and said backstop means providing a resilient force transmitted via said buff taper plate, said wedge means and said follower to the end of said male connector urging it toward said first position and resisting movement of it toward said second position, (v) said cushioning means comprising a single elastomeric pad compressively held between said buff taper plate and said backstop means in an alignment generally perpendicular to the directions in which buff and draft loads are applied, said pad occupying essentially the entire space between said wedge means and being of a thickness sufficient to withstand further compression in resistance to movement of the end of said male connector toward said second position while maintaining said buff taper plate spaced from said backstop means.

2. The draft gear of claim 1, wherein said backstop means is constituted by buff stop means mounted by a draft sill.

3. The draft gear of claim 1, wherein said backstop means is constituted by a surface formed by said female connector at the rear end of said cavity.

4. The draft gear of claim 1, further including means securable to a draft sill for supporting said slack adjustment and cushioning assembly within said draft sill in load transmitting relation therewith.

* * * * *